United States Patent [19]

Anderson

[11] 4,141,588

[45] Feb. 27, 1979

[54] ROCKING LOUNGE CHAIR

[76] Inventor: Paul R. Anderson, 23701 Surf Cove, Laguna Niguel, Calif. 92677

[21] Appl. No.: 905,895

[22] Filed: May 15, 1978

[51] Int. Cl.[2] ..... A63G 19/02

[52] U.S. Cl. ..... 297/258; 297/457; 272/52

[58] Field of Search ..... 297/258, 270, 457; 272/56, 52

[56] References Cited

U.S. PATENT DOCUMENTS

| | | | |
|---|---|---|---|
| 2,930,430 | 3/1960 | Bloom | 297/457 |
| 3,450,435 | 6/1969 | Stephens | 297/457 X |
| 3,596,986 | 8/1971 | Ragsdale | 297/457 |
| 4,037,833 | 7/1977 | Anderson | 272/52 |

*Primary Examiner*—Francis K. Zugel

*Attorney, Agent, or Firm*—William I. Beach

[57] ABSTRACT

A rocking lounge chair for children comprising a generally ellipsoidal shaped body particularly adapted for rocking on a ground surface. A body rest formed into a back, seat and leg rest for a child to recline in a comfortable position thereon is fixedly suspended downwardly within a rectangular opening in the top surface. A bumper guard spaced from the ground surface extends around the lower surface to provide the means for limiting rocking of the body in any position.

5 Claims, 7 Drawing Figures

ROCKING LOUNGE CHAIR

BACKGROUND OF THE INVENTION

1. Field of the Invention

The present invention relates to lounge chairs for children and more particularly to a combination lounge and rocking chair.

2. Description of the Prior Art

In todays society most parents go to considerable means to provide their children with comfortable toys and play devices to keep them quiet and entertained. However, when the child is large enough to sit up on a conventional chair problems develop rapidly in that he seldom rests there quietly for any length of time. After a while he starts to squirm around and may eventually slide off the chair to respond to his need to move about and be active. Attracted by the motion of the family rocking chair the child is usually quite content to sit in it and rock back and forth. Primarily for this reason small size rocking chairs have been produced for the entertainment of small children essentially constructed of a chair mounted on arcuate rails or rockers. Such a rocking chair tends to satisfy the child's need to release body energy but likewise may cause some damage to the child as well as to other objects of furniture in the room. Frequently, a child will rock so violently it causes the chair to tip over and throw him forwardly or backwardly. Should a coffee table or another article or piece of furniture be in the way he may well injure his head, break an arm or leg. In the event he does not get hurt there is always the possibility that the rocking chair will strike and scar a piece of furniture.

As far as applicant knows neither rocking chairs for children or adults are manufactured with built-in means, such as a bumper guard, to limit the angle of tilt in any position or direction. This applies equally as well to conventional rocking chairs and to other forms of rocking devices.

In regard to the latter, multipurpose rocking, reclining and lounging chairs have been proposed that will safely permit an occupant to rock thereon without turning over. A chair of this type is shown in U.S. Pat. No. 3,526,429 issued to H. M. Metzgar. The Metzgar chair consists of a pair of spaced side panels with lower generally arcuate edges in rocking contact with a floor. Each side panel edge has a straight forward portion, a complemental straight rearward position at right angles to the forward portion and an intervening portion which is curvilineal and of a predetermined arc. Several angularly related pallet-like panels are fixedly suspended in the space between the side panels. The alleged self-balancing position of the cradle-like chair provides the occupant a reclining rocker which, in the forward upright position, is a stationary seat and in the rearward position he is reclining with his back parallel to the floor and legs extending upwardly. While it appears that the Metzgar chair will not tip completely over in the fore and aft movement it obviously will not rock in any other direction and therefore is largely limited to a stationary position on the floor. Furthermore, this chair could throw a child out when rocked sufficiently hard backwardly and possibly cause an injury.

A somewhat similarly constructed rocking chair is shown in U.S. Pat. No. 2,482,306 issued to J. J. Waldheim. The Waldheim tilting chair has two spaced side supporting members formed generally into an L-shaped loop of metal tubing. The structure could also be of solid plywood panels essentially of the same design shown in the Metzgar drawing. The two side supporting members are connected by several cross-members to hold them in fixed rocker position. Spaced between the side members is a canvas cover forming the back, seat and leg rest. The Waldheim chair apparently operates in the same manner described by Metzgar and has the same disadvantages for a child's use. It also lacks side supporting structure to prevent a child from tumbling sideways off of the chair.

Therefore, it is the object of the present invention to provide an ellipsoidal-shaped rocking lounge chair in which a child can recline and rock safely as actively as he wishes. Another object is to provide a chair with a bumper guard which will prevent it from turning completely over. Yet another object is to provide a seating or reclining arrangement which will allow the child to rock or rock and rotate the rocking lounge chair in such a manner as to make it travel about on a ground surface in a straight or spiral path without falling out of the chair.

SUMMARY OF THE INVENTION

In carrying out the principles of the present invention in accordance with a preferred embodiment thereof, a generally ellipsoidal-shaped body has a top surface. In the top surface a forwardly extending rectangular opening has an upper short side and a pair of spaced apart downwardly sloping long sides including a lower short side at the front end of the body. The lower surface is adapted for rocking on a ground surface. A body rest depending downwardly in the opening has a pair of spaced apart sidewalls connected at their upper edges to the long sides of the opening and the lower edges to an L-shaped bottom wall. The bottom wall has a downwardly and forwardly extending back portion connected with the upper short side of the opening, a horizontally extending seat portion and a downwardly and forwardly sloping leg portion connected to the short side at the lower end of the opening. There are bumper means extending around the body spaced from the ground surface for rocking contact with the ground surface when rocked by a child reclining in the body so as to prevent the body from tilting beyond a safe angle from the verticle. The bumper means is adapted to exert a reactive force and urge the body towards an upright position.

DETAILED DESCRIPTION

Figure 1:
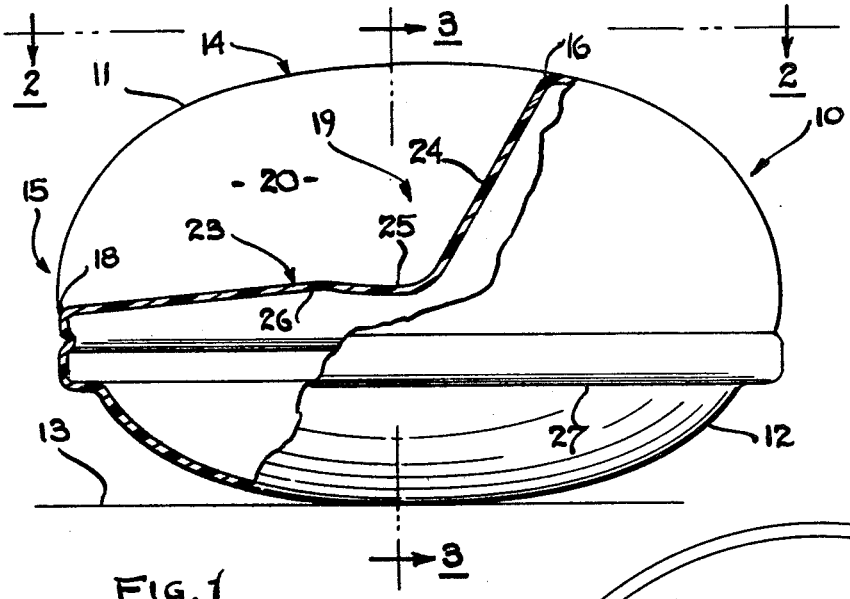
FIG. 1 is a side elevational view taken partly in section through a device representing the present invention.
Figure 2:
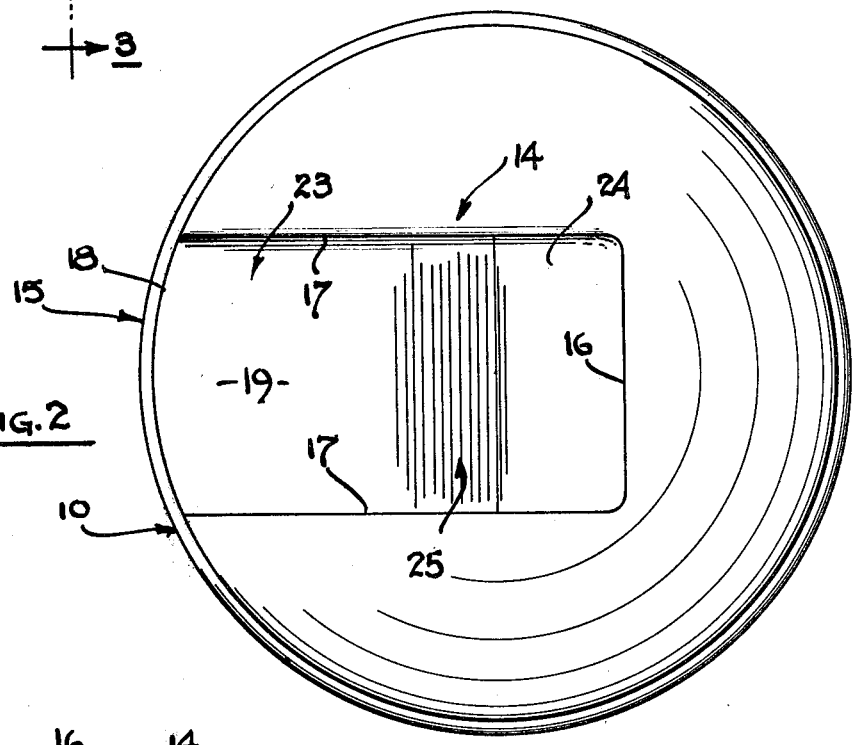
FIG. 2 is a top plan view of FIG. 1 taken along line 2—2.
Figure 3:
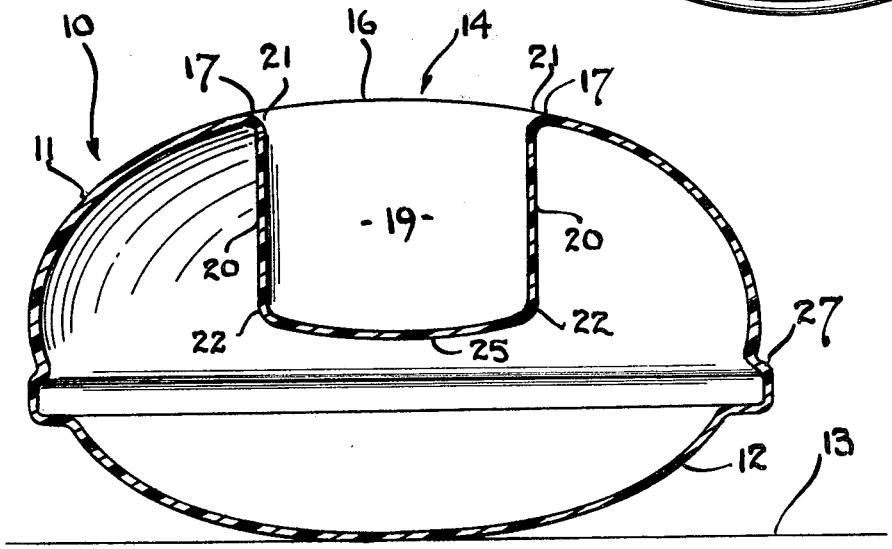
FIG. 3 is a cross-sectional view taken along line 3—3 of FIG. 1 showing the seat portion of the body rest.

Referring to FIGS. 1 and 2 it can be seen that the present invention consists of a generally ellipsoidal-shaped body 10 which has a top surface 11 and a lower surface 12 suitably formed for rocking on a ground surface 13. In the top 11 a rectangular opening 14 extends from in rear of and adjacent to the central verticle axis of body 10 forwardly to the front end 15 of body 10. Opening 14 has an upper short side 16 including a pair of spaced apart long sides 17 sloping downwardly to a lower short side 18. Suspended downwardly in opening 14 is an angularly related body rest 19 comprising a pair of spaced apart side walls 20 which have their upper edges 21 connected to long sides 17 of opening 14 and lower edges 22 connected to an L-shaped bottom wall 23 arranged to conform to the posterior of a reclining child. Bottom wall 23 is formed into a downwardly and forwardly extending back portion 24 from a connection with upper short side 16 of opening 14 including a horizontally extending seat portion 25 and further a downwardly and forwardly sloping leg portion 26 connected to short side 18 at the lower end of the opening. Around the lower surface 12 of body 10 is a bumper guard 27 spaced from ground surface 13 so as to limit the rocking movement of body 10 in any direction to a safe angle of tilt of approximately 25° from the verticle. It is to be understood that by varying the ratio of the major diameter to the minor diameter of body 10 and the height of the position of bumper guard from the ground other safe angles of tilt can be achieved. However, a preferable ratio of minor diameter to major diameter is 1 to 1.7 and the height from the center line of the bumper guard 27 to ground surface 13 is approximately one-third of the distance from the major axis to said ground surface for a safe angle of tilt of approximately 25° from the verticle. Therefore, when bumper guard is rocked in contact with ground surface 13 the reactive force of impact acts on body 10 to urge it upwardly towards an upright position.

Figure 4:
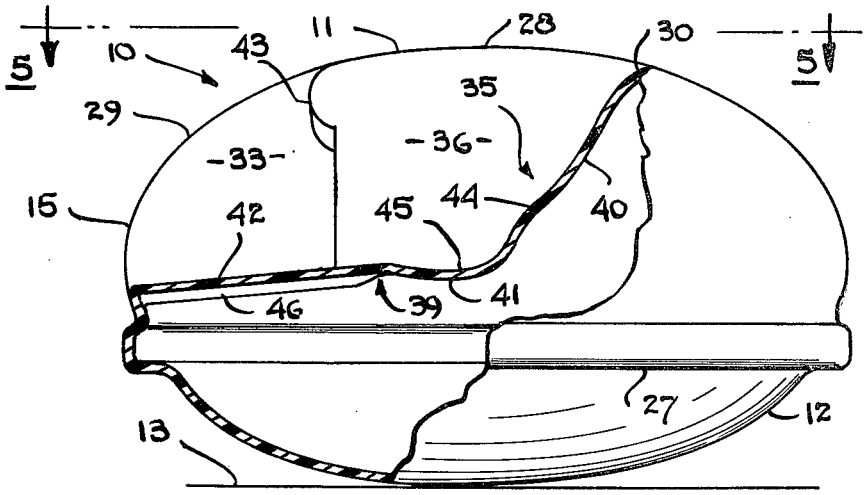
FIG. 4 is a modified form of FIG. 1 taken partly in section.
Figure 5:
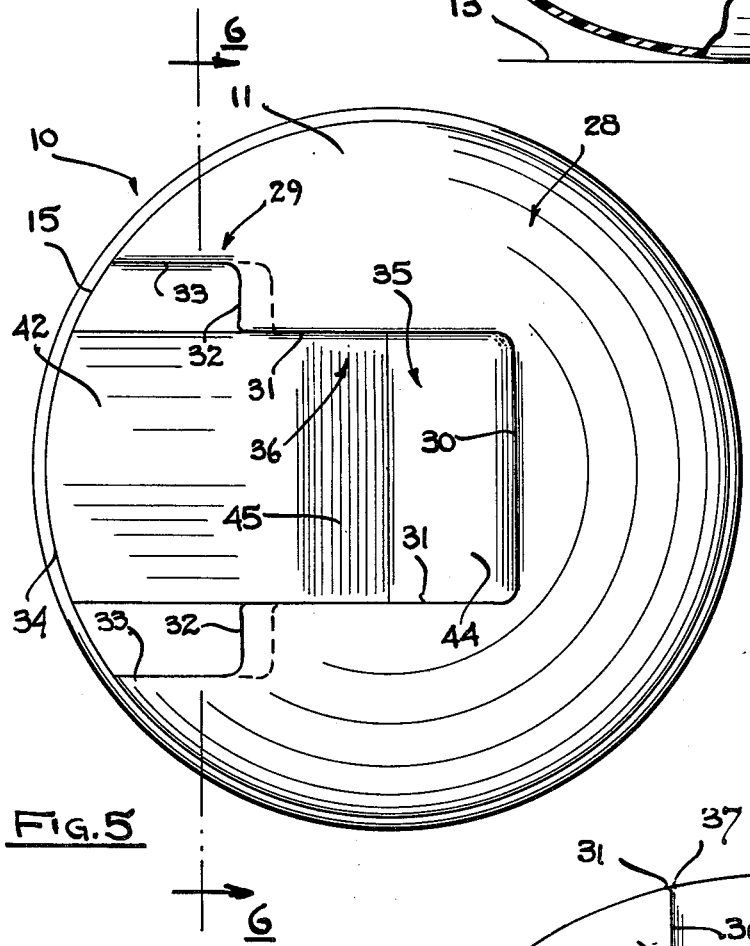
FIG. 5 is a top plan view of FIG. 4 taken along line 5—5.
Figure 7:
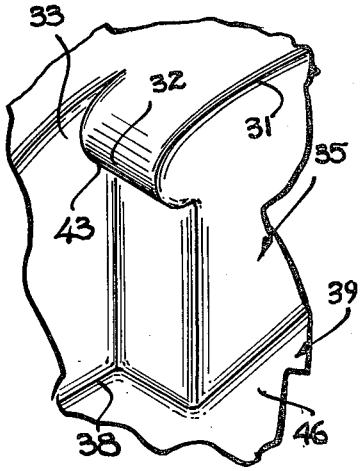
FIG. 7 is an isolated fragmented view of one of the incremental sides and handholds at the juncture of the first section and the second section of the rectangular opening.
Figure 6:
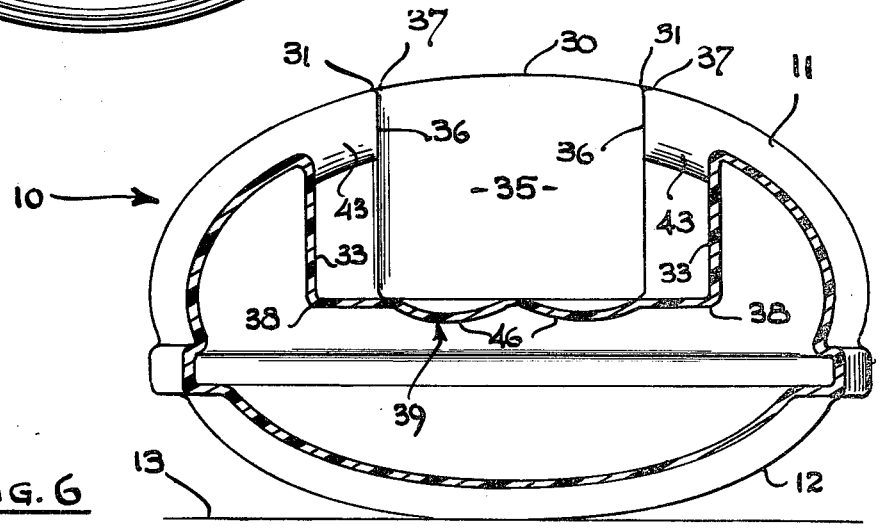
FIG. 6 is a cross-sectional view taken along line 6—6 of FIG. 5 showing the pair of handholds and channels in the leg rest portion of the body.

A modified form of the present invention is shown in FIGS. 4, 5 and 6. Referring to FIG. 5, it is seen that the somewhat irregular rectangular opening consists of a first section 28 and a second section 29. The first section 28 has an upper short side 30 and a pair of spaced long sides 31 sloping downwardly to an open end juncture with left and right incremental sides 32 of the wider second section 29. Second section 29 has a pair of spaced short sides 33 sloping downwardly from the incremental sides 32 to a lower connection to a long side 34 at the front end 15 of body 10. Suspended downwardly within the first and second sections is a body rest 35 comprising a pair of spaced side walls 36 connected at their upper edges 37 to long sides 31 of the first section 28, then to incremental sides 32 and the downwardly sloping short sides 33 of second section 29. At the juncture of the first and second sections side walls 36 are formed at right angles and parallel to left and right hand incremental sides 32 and than again at right angles and parallel to downwardly sloping sides 33 of second section 29. The lower edges 38 of side walls 36 are further connected to an L-shaped bottom wall 39 adapted to support the posterior parts of a reclining child. Connected also to upper short side 30 of first section 28, bottom wall 39 is formed downwardly and forwardly into back portion 40, horizontally extending seat portion 41 and downwardly and forwardly sloping leg portion 42 to a connection with long side 34 at the lower end of second section 29. To provide a child with the means for mounting or rising from body rest 35 as well as a hand gripping member on which to hang when rocking body 10 handholds 43 are formed at the juncture of the first and second sections. Handholds 43 are essentially formed into semi-cylindrical rolls projecting laterally from the upper edge connection of side walls 36 to the left and right hand incremental sides 32. An illustration of handhold 43 is shown in FIG. 7. To further provide comfortable means for reclining on bottom wall 39 a slight convex bulge 44 is formed in back portion 40 to support the child's lower back region, a shallow basin 45 formed in seat portion 41 to support his buttocks and a pair of spaced channels formed in leg portion 42 to support his legs.

In operating the present invention a child simply lowers himself onto the bottom wall 39 and grasping handholds 43 prepares to activate body 10 into rocking motion. If he sits up straight in the seat portion 41 or leans back against back portion 40 without moving about or shifting his weight suddenly the relatively broad curvature lower surface 12 resting on ground surface 13 will hold body 10 in a reasonably stable upright position. When the child wishes to activate the body into rocking motion he can grasp handholds 43 and throw his weight in the direction he wishes the body to rock. The directional change in the child's weight will impart momentum to the body and cause it to tilt forward, backward or sideways until bumper guard 27 strikes ground surface 13. When the bumper guard contacts the ground movement of the body tending to tip over is halted and if the impact is hard enough a reactive force is imparted on the body uring it towards an upright position. The upward momentum together with the child's weight shifting momentum causes the body to swing past the verticle position and start downward again in the opposite direction until the bumper strikes the ground on the other side of the body. The rocking movement will continue as long as the child chooses to keep the body in motion and he can manipulate the movement so as to rock at any angle in a circle of 360°. By causing the body to change direction in the process of rocking back and forth he can make it wobble around a circular path or travel on the floor from wall to wall. This is accomplished by making the bumper strike the ground on one side of the body with more impact than the other side resulting in the body sliding in the direction of the side of lesser impact.

From the description and illustration of the present invention it is obvious that it provides many important advantages which can be utilized effectively by virtue of the unique construction of the ellipsoidal-shaped body.

The foregoing description is to be clearly understood to be given by way of illustration and example only, that the spirit and scope of the present invention being limited solely by the appended claims.

I claim:

1. A rocking lounge chair for children, which comprises:

an ellipsoidal-shaped body having a top surface, a forwardly extending T-shaped rectangular opening in the top surface including a first section having an upper short side and a pair of downwardly sloping long sides connected to laterally extending incremental sides of a wider second section having downwardly sloping short sides connected to a lower long side at the front end of the body and a lower surface adapted for rocking on a ground surface, a body rest suspended downwardly in the opening comprising a pair of spaced apart sidewalls having upper arcuate edges connected to the long sides of the first section, then folded laterally around the corners of the incremental sides of the second section and than folded again to a connection with the long sides of said second section of said opening and the lower edges connected to an L-shaped bottom wall having a back portion extending downwardly and forwardly from a connection with the upper short side of said opening, a horizontally extending seat portion and a downwardly and forwardly sloping leg portion connected to the short side at the lower end of said opening, and bumper means extending around said body and spaced from the ground surface for rocking contact with said ground surface when rocked by a child reclining in the body rest so as to prevent said body from overturning beyond a safe angle from the verticle, the bumper means being adapted to exert a reactive force and return said body to an upright position.

2. A rocking lounge chair as recited in claim 1, wherein:

the sidewalls folded around the corner of the incremental sides of said second section form a lateral semi-cylindrical roll at the upper edges thereof to provide a handhold for the child to grasp when reclining or rising in the body rest.

3. A rocking lounge chair as recited in claim 1, wherein:

the handhold and adjacent area on said top surface are textured so as to provide adequate non-slipping surface.

4. A rocking lounge chair as recited in claim 1, wherein:

the body rest is formed so as to provide a convex surface in the back portion to support the lower back region of said child, a shallow dishlike basin in the seat portion and a pair of downwardly extending channels in the leg portion to support said child's legs therein.

5. A rocking lounge chair as recited in claim 1, wherein:

the ellipsoidal-shaped body is essentially constructed of plastic reinforced material.

* * * * *